US008268110B2

(12) United States Patent
Pien

(10) Patent No.: US 8,268,110 B2
(45) Date of Patent: Sep. 18, 2012

(54) METHOD AND APPARATUS FOR FLOOR PLANKS

(75) Inventor: Chao Kang Pien, Edison, NJ (US)

(73) Assignee: Advance Vinyl Floor Manufacturing Corp., Edison, NJ (US)

( * ) Notice: Subject to any disclaimer, the term of this patent is extended or adjusted under 35 U.S.C. 154(b) by 231 days.

(21) Appl. No.: 12/769,736

(22) Filed: Apr. 29, 2010

(65) Prior Publication Data

US 2011/0265946 A1 Nov. 3, 2011

(51) Int. Cl.
*B29C 65/00* (2006.01)
*B32B 37/00* (2006.01)
*B32B 38/04* (2006.01)

(52) U.S. Cl. ..... 156/257; 156/304.5; 156/249; 156/196; 156/182; 156/268; 156/258; 156/263; 156/254; 52/591.4

(58) Field of Classification Search ..... 156/304.5, 156/249, 196, 182, 268, 257, 258, 263, 254; 52/591.4

See application file for complete search history.

(56) References Cited

U.S. PATENT DOCUMENTS

| | | | | | |
|---|---|---|---|---|---|
| 1,978,075 | A * | 10/1934 | Butterworth | 52/506.01 |
| 2,455,777 | A * | 12/1948 | Jones | 428/204 |
| 2,914,815 | A * | 12/1959 | Alexander | 52/592.1 |
| 3,551,850 | A * | 12/1970 | Dalpee et al. | 332/168 |
| 3,988,187 | A * | 10/1976 | Witt et al. | 156/71 |
| 4,426,820 | A * | 1/1984 | Terbrack et al. | 52/590.1 |
| 6,922,965 | B2 * | 8/2005 | Rosenthal et al. | 52/592.1 |
| 7,155,871 | B1 | 1/2007 | Stone et al. | 52/591.4 |
| 7,322,159 | B2 | 1/2008 | Stone et al. | 52/741.3 |
| 2010/0281810 | A1 * | 11/2010 | Ruland | 52/588.1 |
| 2010/0319282 | A1 * | 12/2010 | Ruland | 52/309.3 |

* cited by examiner

*Primary Examiner* — Linda L Gray
(74) *Attorney, Agent, or Firm* — Walter J. Tencza, Jr.

(57) ABSTRACT

A method comprising the steps of putting together a first piece including a wear layer, a pattern layer, and a base layer, arranged in a sandwich manner, such that the wear layer is on top of the pattern layer, the pattern layer is on top of the base layer, and the pattern layer is in between the wear layer and the base layer. The method may also include removing portions of the first piece to form a first floor plank, such as by removing a first substantially L-shaped portion of the wear layer, removing a second substantially L-shaped portion of the pattern layer, and removing a third substantially L-shaped portion of the base layer. Adhesive may be applied to locations on the first floor plank where substantially L-shaped portions have been removed to adhere the first floor plank to one or more substantially identical floor planks.

18 Claims, 10 Drawing Sheets

METHOD AND APPARATUS FOR FLOOR PLANKS

FIELD OF THE INVENTION

This invention relates to improved methods and apparatus concerning floor planks, such as for example, vinyl floor planks, rubber floor planks and other resilient floor planks.

BACKGROUND OF THE INVENTION

There are various devices known in the prior art concerning floor planks. One or more prior art techniques concerning floor planks are shown in U.S. Pat. Nos. 7,155,871 and 7,322,159, which are incorporated by reference herein.

SUMMARY OF THE INVENTION

At least one embodiment of the present invention provides a method comprising the steps of putting together a first piece, wherein the first piece is comprised of a wear layer, a pattern layer, and a base layer, with the wear layer, the pattern layer, and the base layer arranged in a sandwich manner, such that the wear layer is on top of the pattern layer, the pattern layer is on top of the base layer, and the pattern layer is in between the wear layer and the base layer. The method may also include removing portions of the first piece to form a first floor plank.

The step of removing portions of the first piece to form a first floor plank may include removing a first substantially L-shaped portion of the wear layer, removing a second substantially L-shaped portion of the pattern layer, and removing a third substantially L-shaped portion of the base layer. The first substantially L-shaped portion of the wear layer and the second substantially L-shaped portion of the pattern layer are substantially the same size and shape, and are substantially aligned with one another prior to being removed from the first piece. The third substantially L-shaped portion of the wear layer is not aligned with the second substantially L-shaped portion of the pattern layer or the first substantially L-shaped portion of the wear layer prior to being removed from the first piece.

The step of removing portions of the first piece to form a first floor plank may be performed by a machine, such as a bevel machine.

The method may also include applying adhesive to locations on the first floor plank corresponding to where portions of the first piece have been removed. A removable covering may be applied to the adhesive so that the first floor plank can be stored for later installation as part of a floor covering.

The step of removing the first substantially L-shaped portion of the wear layer and the second substantially L-shaped portion of the pattern layer may include forming a first substantially L-shaped slot and a first substantially L-shaped rail. The step of removing the third substantially L-shaped portion of the base layer may include forming a second substantially L-shaped slot and a second substantially L-shaped rail. Adhesive may be applied to at least one of the first and the second substantially L-shaped slots and to at least one of the first and second substantially L-shaped rails, for adhering one floor plank with one or more substantially identical floor planks.

The method may further include applying a removable covering to the adhesive so that the first floor plank can be stored for later installation as part of a floor covering. The method may further include removing the removable covering from the first floor plank, and adhering the first floor plank to a second floor plank, which is substantially identical to the first floor plank, by adhering locations on the first floor plank corresponding to where portions of the first piece have been removed to locations on the second floor plank corresponding to where portions of a second piece have been removed, wherein the second piece is substantially identical to the first piece.

DETAILED DESCRIPTION OF THE DRAWINGS

Figure 1A:
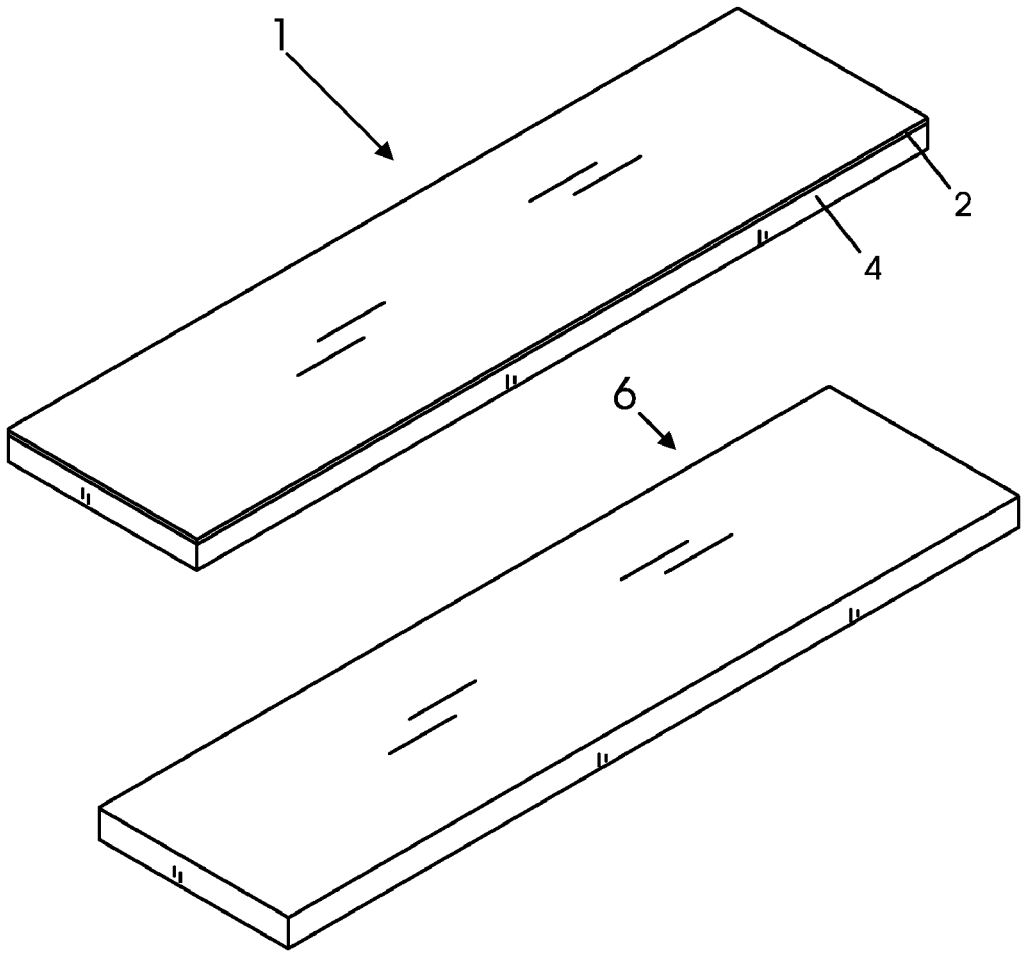
Fig. 1A (Prior Art)
FIG. 1A shows a top front, right perspective view of two parts for creating a floor plank in accordance with a prior art technique, with the two parts not connected together.

FIG. 1A shows a top front, right perspective view of a part 1 and a part 6 for forming a floor plank in accordance with a prior art technique, with the two parts not connected together.

Figure 1B:
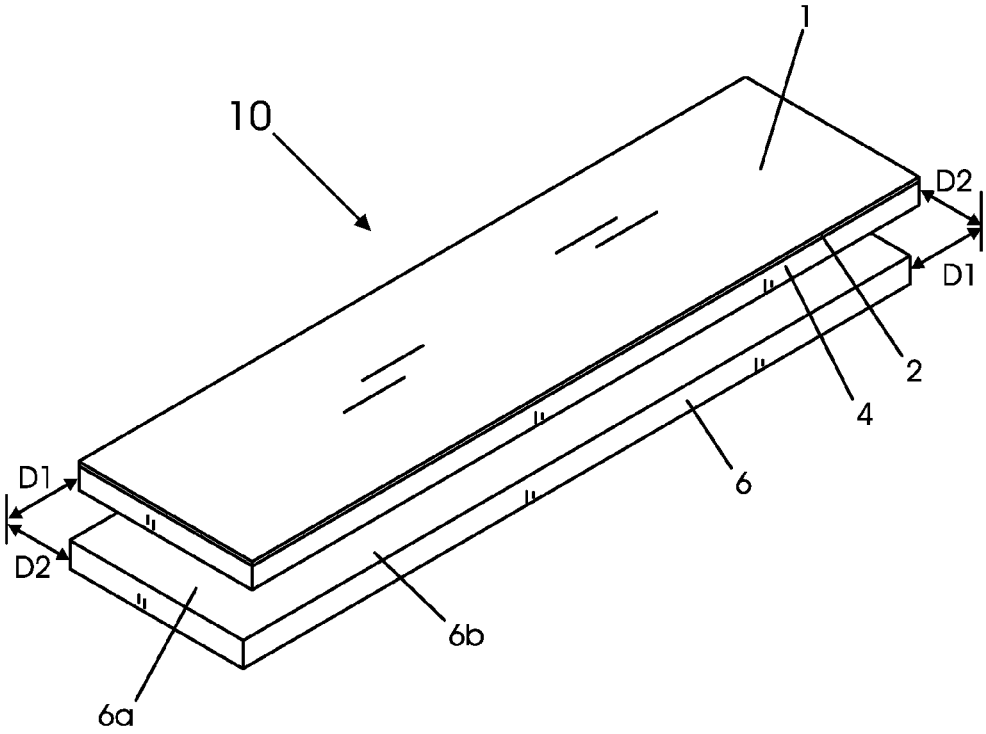
Fig. 1B (Prior Art)
FIG. 1B shows the two parts of the floor plank of FIG. 1A, with the two parts attached to each other in an offset manner, in accordance with a prior art technique.
Figure 7:
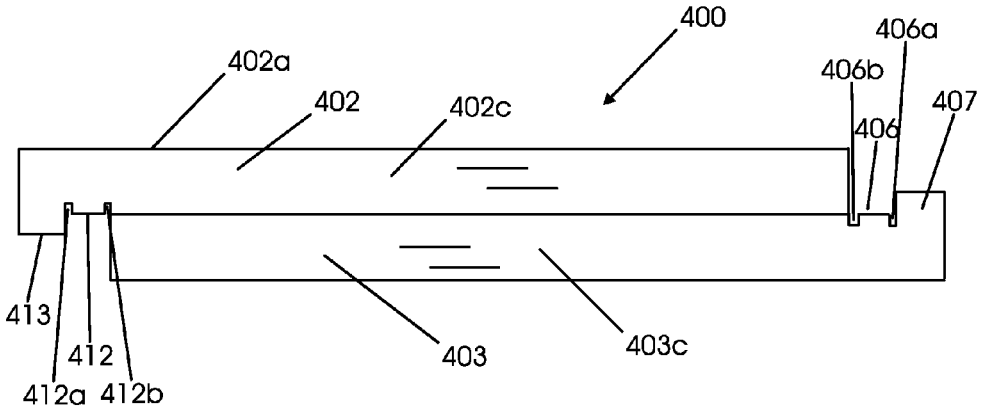
FIG. 7 shows a left side view of a floor plank in accordance with another embodiment of the present invention.
Figure 8:
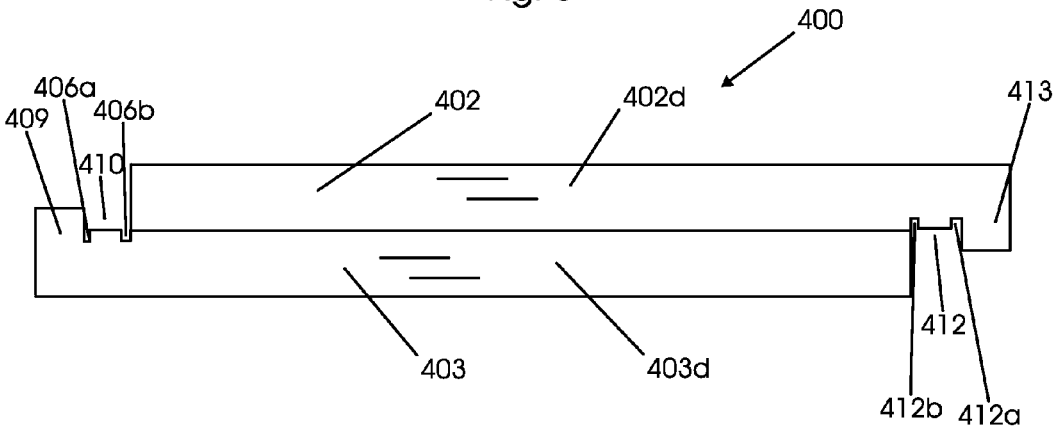
FIG. 8 shows a right side view of the floor plank of FIG. 7.
Figure 9:
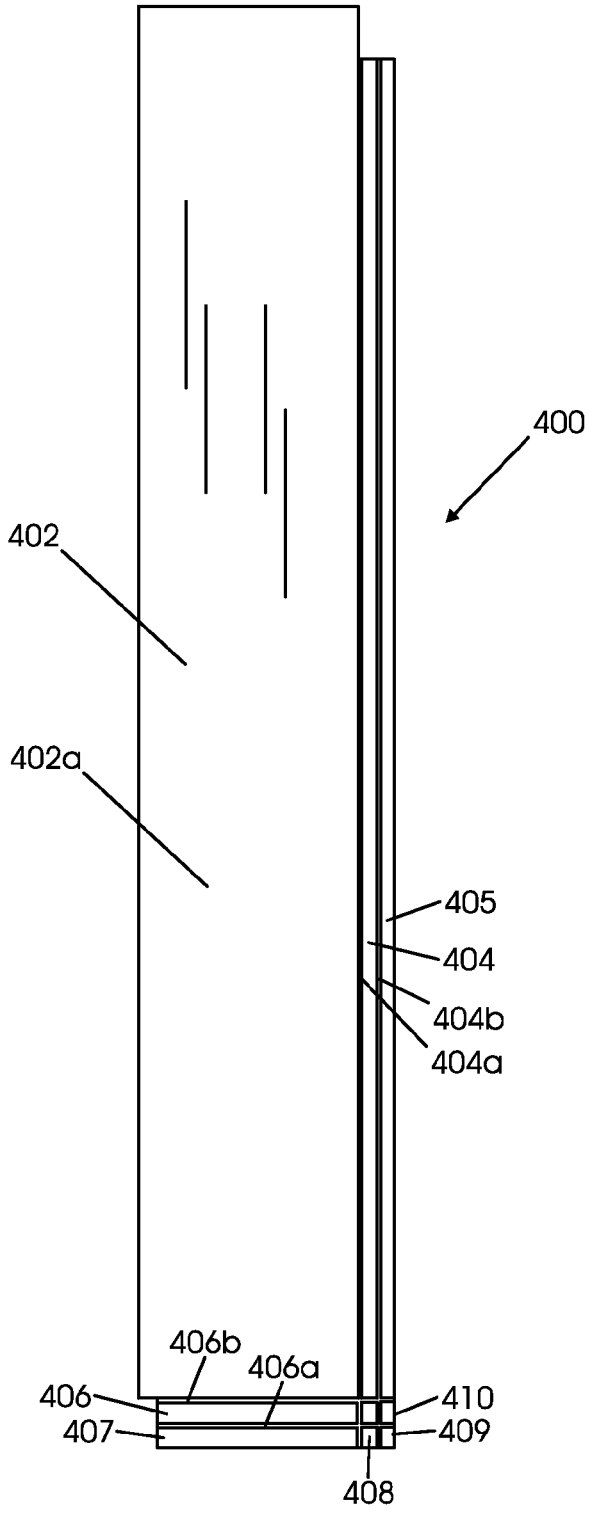
FIG. 9 shows a top view of the floor plank of FIG. 7.
Figure 10:
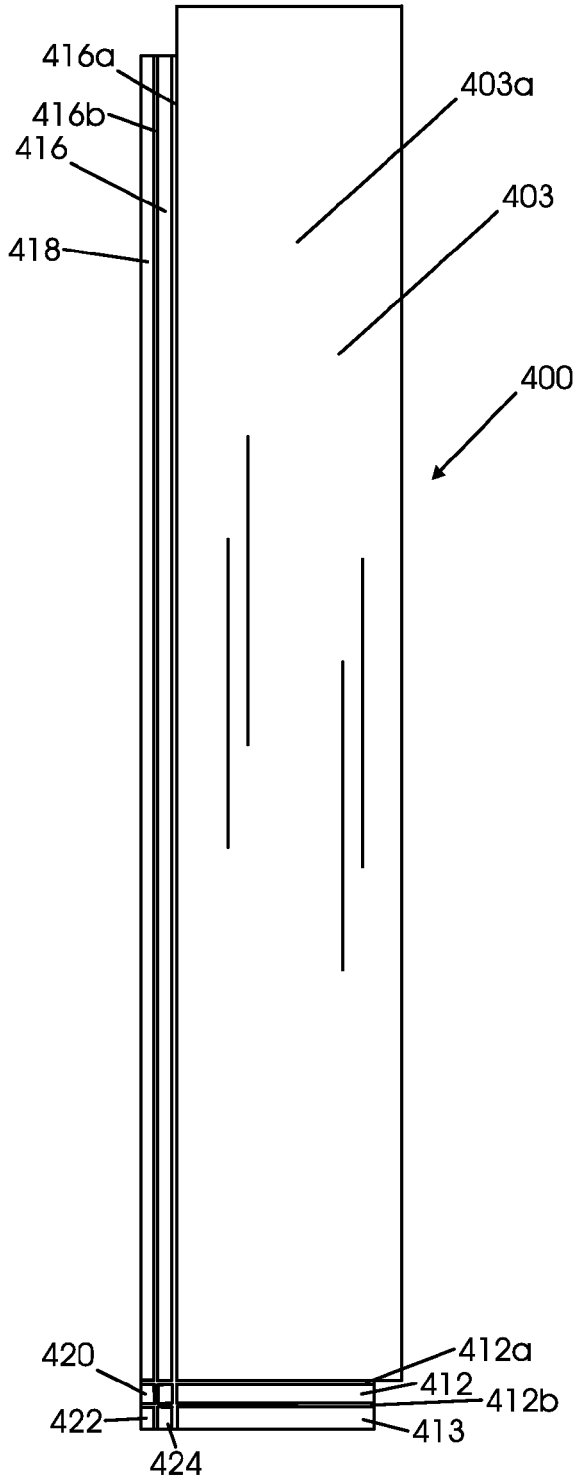
FIG. 10 shows a bottom view of the floor plank of FIG. 7.

FIG. 1B shows the part 1 and part 6 of FIG. 1A, with the two parts 1 and 6 attached to each other in an offset manner, in accordance with a prior art technique. Such a prior art technique is shown in U.S. Pat. Nos. 7,155,871 and 7,322,159, which are incorporated by reference herein. In these patents, a top layer 14, which typically includes a design, such as a synthetic wood grain or a polyvinyl chloride (PVC) design, is laminated to a middle plastic layer 16, in an offset manner to form a plank 100. (U.S. Pat. Nos. 7,155,871 and 7,322,159, FIG. 7; col. 3, In. 60-65).

Figure 2:
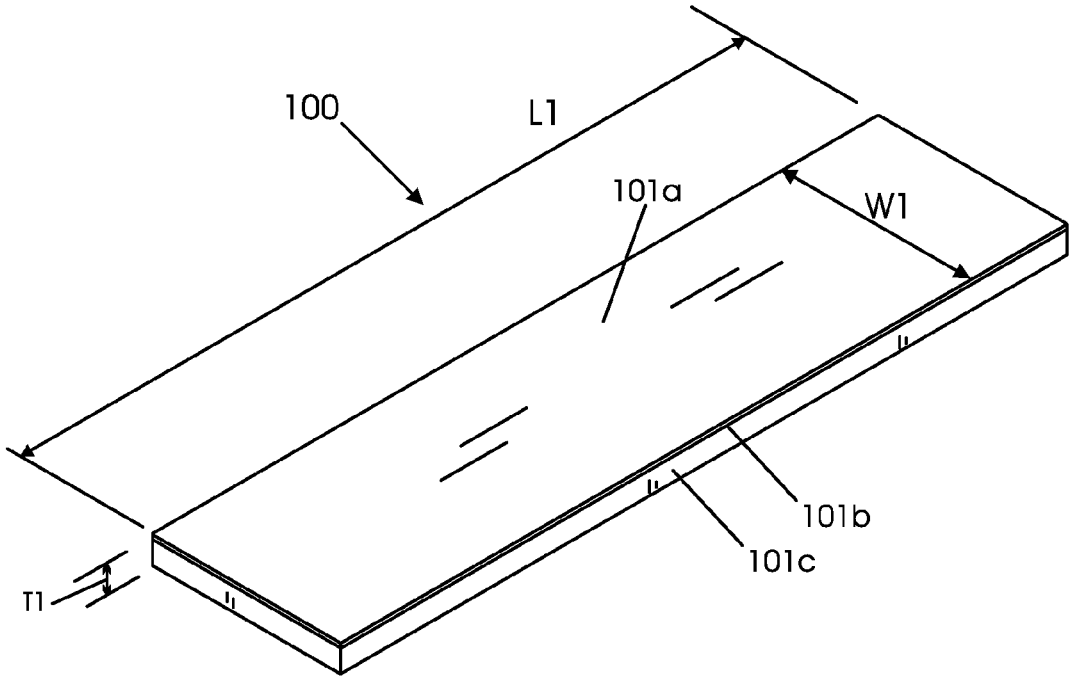
FIG. 2 shows a top, front, right perspective view of a piece to be used to create a floor plank in accordance with an embodiment of the present invention.

FIG. 2 shows a top, front, right perspective view of a piece 100 to be used to create a floor plank 100*a* (shown in FIG. 3) in accordance with an embodiment of the present invention. The piece 100 may be a rectangular block or strip having a top surface 101*a*. The piece 100 may have a layer 101*b* and a layer 101*c*. The layer 101*b* may include a wear layer or sublayer and a pattern (or design) layer or sublayer. The wear layer of the layer 101*b* may be a thin transparent layer. The pattern (or design) layer of the layer 101*b* may be a thin design layer, such as a synthetic wood grain design layer or a polyvinyl chloride synthetic wood grain design layer. The layer 101*c* may also be called a base layer. The piece 100 may have a length L1 and a width W1.

Figure 3:
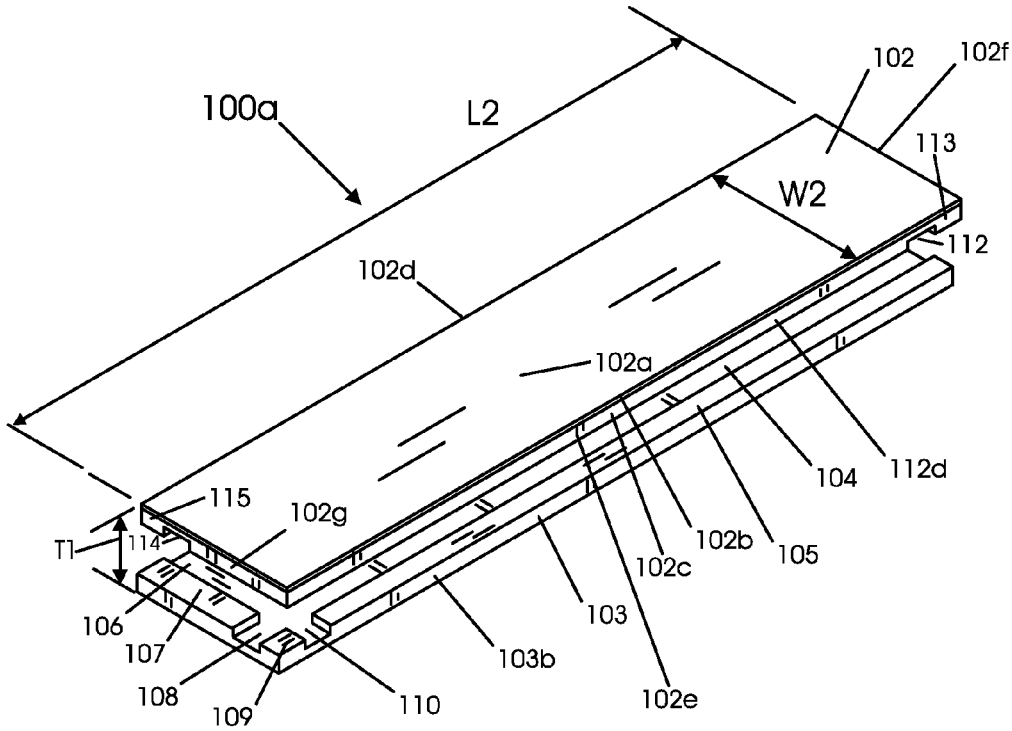
FIG. 3 shows a top, front, right perspective view of a floor plank, which has been created from the piece of FIG. 2, in accordance with an embodiment of the present invention.
Figure 4:
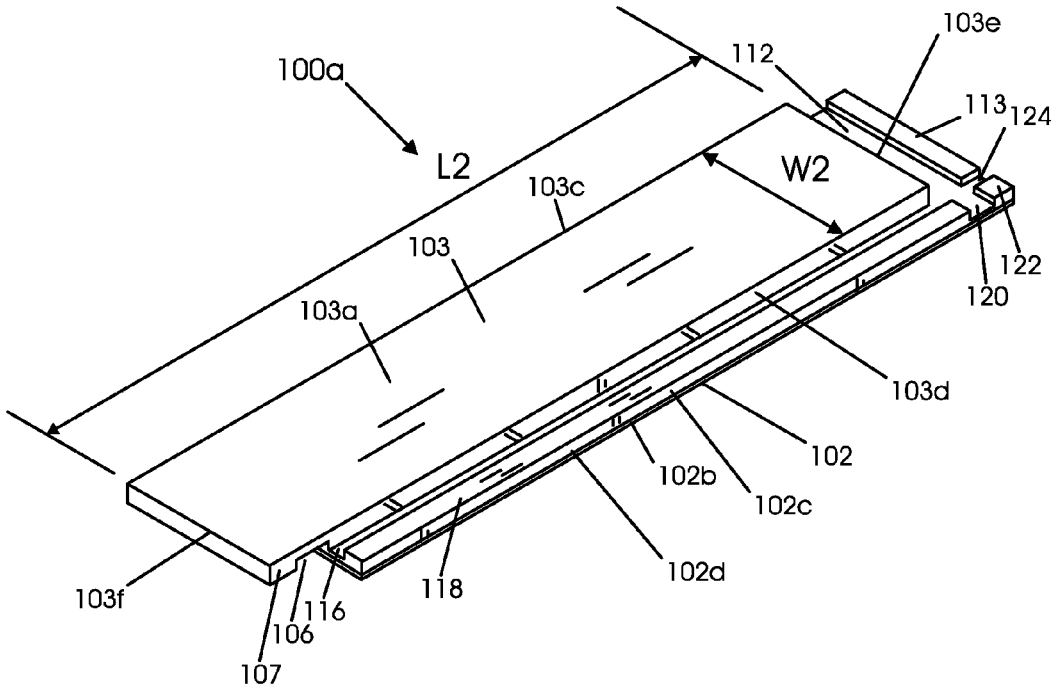
FIG. 4 shows a bottom, front, left perspective view of the floor plank of FIG. 3.

FIG. 3 shows a top, front, right perspective view of a floor plank 100*a*, created from the piece 100 in accordance with an embodiment of the present invention. FIG. 4 shows a bottom, front, left perspective view of the floor plank 100*a*. The floor plank 100*a* may be created from the piece 100 of FIG. 2, by cutting, beveling, etching, sculpting, carving, or chiseling out or otherwise removing portions of the piece 100. Thus the floor plank 100*a* is formed from a piece 100 in accordance with at least one embodiment of the present invention, in contrast to the prior art plank of U.S. Pat. Nos. 7,155,871 and 7,322,159 which is formed by laminating one layer onto another, in those patents.

The floor plank 100*a* shown in FIG. 3, formed from the piece 100, includes a top portion 102 and a bottom portion 103. The top portion 102 may have a wood veneer surface 102*a* or synthetic plastic surface for a floor. The surface 102*a* may be printed plastic. The top portion 102 may include a layer 102*b* and a layer 102*c*. The layer 102*b* may include a wear layer and a pattern or design layer. The layer 102*b* has a length L2, which is less than L1 in FIG. 2, and a width W2 which is less than the width W1. The layer 102*b* is a modified version of the layer 101*b*, with an L-shaped section of the layer 101*b* removed by cutting, beveling, etching, sculpting, carving, or chiseling out or otherwise removing the L-shaped section of the layer 101*b* to form the layer 102*b*. The combination of the layer 102*c* and the portion 103 shown in FIG. 3, is a modified version of the layer 101*c* of the piece 100 shown in FIG. 2, with various portions of the layer 101*c* removed by cutting, beveling, etching, sculpting, carving, or chiseling out or otherwise removing various portions, such as L-shaped portions, of the layer 101*c* to form the layer 102*c* and portion 103.

The layer 102*c* and the portion 103 shown in FIG. 3 may substantially be made of PVC (polyvinyl chloride) synthetics, which may be of the type used in conventional vinyl floor planks.

The floor plank 100*a* may further include slots or channels 104, 106, 108, and 110 shown in FIG. 3, and slots or channels 112, 116, 120, and 124 shown in FIG. 4, which may be formed by cutting, beveling, etching, sculpting, carving, or chiseling out or otherwise removing various portions, such as for example L-shaped portions, of the piece 100 of FIG. 2 to form the floor plank 100*a* of FIG. 3. The floor plank 100*a* may further include rails or protrusions 105, 107, 109, 113, and 115 shown in FIG. 3, and rails or protrusions 118 and 122 shown in FIG. 4, which may be formed by cutting, beveling, etching, sculpting, carving, or chiseling out or otherwise removing various portions of the piece 100 of FIG. 2 to form the floor plank 100*a* of FIG. 3.

The floor plank 100*a* may include a base layer which may be comprised of layer 102*c* and portion 103. The base layer may include a balance layer and a leveling layer. Typically, in at least one embodiment, only a base layer comes out of a calendering machine or extruder machine. The base layer is then immediately laminated, first with a pattern film and then with a wear layer, or with the pattern film and the wear layer at the same time, to form the piece 100 shown in FIG. 2. To form the piece 100, the combination of the wear layer and the pattern film or design layer 101*b* is laminated to the base layer 101*c*, to form a uniform rectangular block or strip in which layers 101*b* and 101*c* are aligned and neither of the layers 101*b* and 101*c* extend substantially beyond the other layer.

The wear layer is transparent, is part of the layer 102*b*, and is on the surface 102*a* of the floor plank 100*a* shown in FIG. 3. The pattern layer lies underneath the wear layer or surface 102*a*, and is also part of the layer 102*b*. The pattern layer typically takes up a relatively small part or cross section versus the cross section taken up by the layer 102*c* and the portion 103. As examples, the thickness of the pattern layer (of layer 102*b*) or film may be about 0.07 millimeters, while the typically transparent wear layer (of layer 102*b* in FIG. 3) or surface 2*a* can be from 0.03 millimeters to 1.2 millimeters. A wear layer in the range of 0.03 millimeters to 0.30 millimeters wear layers usually is used with an overall tile/plank 100*a* thickness T1, shown in FIG. 3, of between 1.5 millimeters and 3.0 millimeters. The overall plank thickness of plank 100*a* shown in FIG. 3 is equal to the thickness T1 of the unmodified piece 100 shown in FIG. 2. A wear layer in the range of 0.35 millimeters to 1.2 millimeters typically would be used with an overall tile/plank 100*a* thickness T1 above 2.5 millimeters.

Typically a cutting die would be used to form the edges of the piece 100 which may be in the form of a conventional known plank or tile. A bevel machine or some other type of machine can be used to cut, bevel, etch, sculpt, carve, chisel out or otherwise form the slots or channels such as, slots or channels 104, 106, 108, 110, shown in FIG. 3, and slots or channels 112, 116, 120, and 124 shown in FIG. 4 or to form the rails or protrusions 105, 107, 109, 113, and 115 shown in FIG. 3, and rails or protrusions 118 and 122 shown in FIG. 4, in order to modify the piece 100 of FIG. 2 into the floor plank 100*a* of FIG. 3.

The base layer 101*c* of the unmodified piece 100 may be made in advance by calendering (sophisticated, base layer will be thin) or by sets of rollers (simple, base layer will be thicker). The wear layer, pattern film (layer 101*b* includes wear layer and pattern layer) and base layer (layer 101*c* may then be properly aligned, so that each layer has substantially the same length and width, is aligned with the other layers, and does not extend substantially beyond the other layers. After cutting, the aligned layers (101*b* and 101*c*) may then be sent to a hot press machine for lamination to form the piece 100.

A cutting die can be installed with a calendering machine or extrusion machine, so the entire production process may be made to be automatic and continuous. But due to technique bottleneck or budget limit, factory can also cut lamination sheet into slab, then send to independent, or stand off, cutting die to shape into piece 100.

The wear layer or the layer 101*b* is transparent, and typically has a thickness of from 0.03 millimeters to 1.2 millimeters. The base layer, or layer 101*c* of the piece 100, can itself be comprised of more than one layer, such as one, two, or three layers, typically depending on the thickness T1 of the piece 100. Although the base layer 101*c* may be comprised of more than one layer, it will still appear to be one layer, because any multiple layers of the base layer 101*c* will be laminated together, unless the layers are different colors.

The wear layer of the layer 101*b* of the piece 100, may be pure PVC, with greater pulling power(upward) when temperature goes down (for example, a relatively higher processing temperature versus relatively lower room temperature), and for such a PVC wear layer, typically a balance layer as part of the base layer 101*c* of the piece 100 is used to offset the pulling power of the wear layer. A leveling layer of the base layer 101*c* of the piece 100, would be the bottommost layer and is aimed at the subfloor or underlayment. If the subfloor or underlayment is uneven or not level, a relatively flexible leveling layer can help to keep a floor comprise of a plurality of planks identical to plank 100*a*, flat.

A fiber glass layer may optionally be placed between the pattern film layer at the bottom of layer 101*b* and the base layer 101*c* (or may be placed between leveling layer and balance leveler), however alternatively, fiber glass materials can be mixed in with the base layer 101*c* of the piece 100. Fiber glass materials mixed in with the base layer 101*c* can provide better dimensional stability.

For the lowest (price wise) end product for residential uses, a pattern may be printed on the back of a wear layer, then a pure white film may be paved underneath the pattern (on the non-pattern side) which is called a "feature layer/film". The combination wear layer (with pattern on back) and "feature layer/film" may then be laminated onto a base layer, and thereafter a large slab or sheet including the combination wear layer and the base layer may be die cut to form a plurality of pieces each identical or similar to piece 100. For better anti-scratch, anti-cuff and better durability of the surface 102*a,a* coating may be spread on top of the surface 102*a*, such as a polyurethane coating. A coating of silicone, Teflon, or epoxy and other types of coatings may also be used on the surface 102*a*.

On the back of the floor plank or tile such as on surface 103*a*, shown in FIG. 4, there is typically a need to provided protection from moisture from the subfloor or underlayment under the tile/plank 100*a*. A sealer may be applied to the back surface 103*a*, or the sealer may be laminated onto the back surface 103*a*. The sealer may be an anti-moisture film, for example such as a thin layer of pure PVC (polyvinyl chloride) film.

Figure 5:
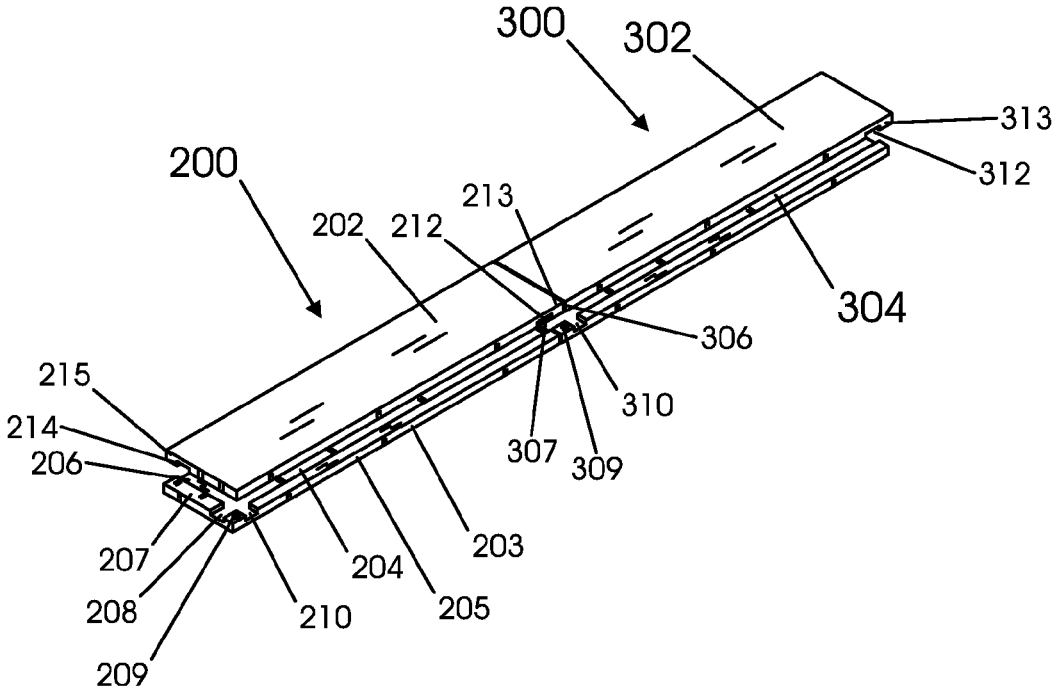
FIG. 5 shows a top, front, right perspective view of two identical floor planks in accordance with an embodiment of the present invention, connected to each other lengthwise.

FIG. 5 shows a top, front, right perspective view of two identical floor planks 200 and 300 in accordance with an embodiment of the present invention, connected to each other lengthwise. Each of floor planks 200 and 300 is the same as floor plank 100*a* shown in FIGS. 3 and 4. The floor plank 200 includes rails 205, 207, 209, 213, and 215 shown in FIG. 5, which are the same as rails 105, 107, 109, 113, and 115, respectively. Floor plank 200 includes slots or channels 204, 206, 208, 210, and 212 shown in FIG. 5 which are the same as slots or channels 104, 106, 108, 110, and 112, respectively. The floor plank 300 includes rails 307, 309, and 313 shown in FIG. 5 which are the same as rails 107, 109, and 113, respectively. The floor plank 300 includes slots or channels 310, 304, and 312, shown in FIG. 5, which are the same as slots or channels 110, 104, and 112, respectively. In FIG. 5, the rail 307 of the floor plank 300 fits into the slot 212 of the floor plank 200; and the rail 213 of the floor plank 200 fits into the slot 306 of the floor plank 300 to connect the floor planks 200 and 300 lengthwise.

Figure 6:
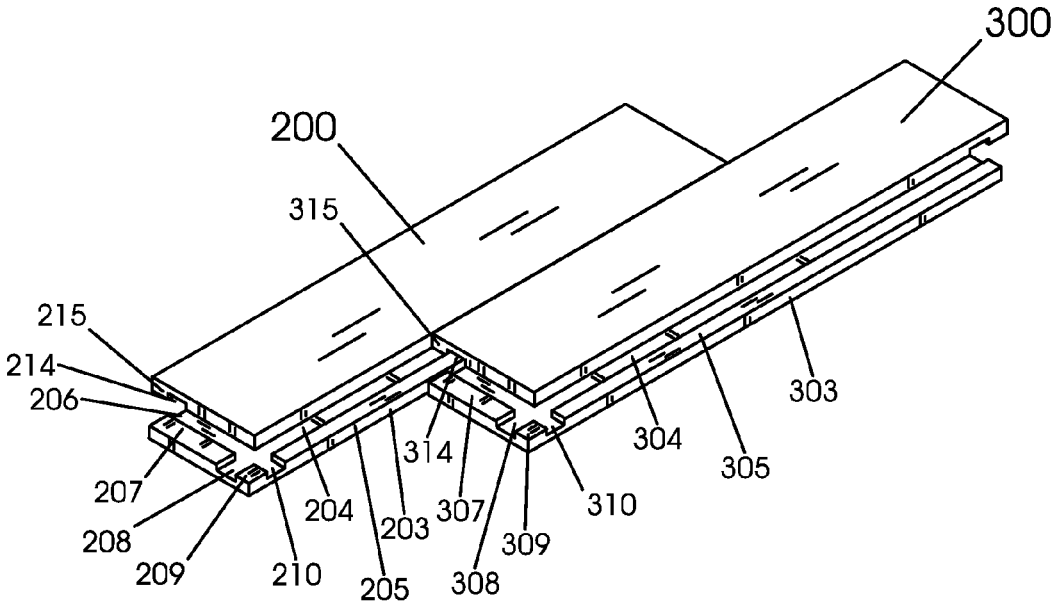
FIG. 6 shows a top, front, right perspective view of two identical floor planks in accordance with an embodiment of the present invention, connected to each other widthwise.

FIG. 6 shows a top, front, right perspective view of two identical floor planks 200 and 300 in accordance with an embodiment of the present invention, connected to each other widthwise. The two floor planks 200 and 300 may be offset with respect to each other when they are connected. Any further number of identical floor planks (similar to floor plank 100*a* in FIG. 3) can be connected lengthwise to the arrangement shown in FIG. 5 and widthwise to the arrangement shown in FIG. 6 to cover an entire floor. In FIG. 6, the rail 315 of the floor plank 300 fits into the slot 204 of the floor plank 200; and the rail 205 of the floor plank 200 fits into the slot 314 of the floor plank 300 to connect the floor planks 200 and 300 widthwise.

The piece 100 shown in FIG. 2 can be produced by a process such as a process involving the use of a calender (a series of hard pressure rollers), by an extrusion process (a process used to create objects of fixed cross-sectional profile), or by a hot press or flat press process (such as involving the simultaneous application of heat and pressure).

The base layer 101*c* of the piece 100 of FIG. 2, can be comprised of a balance layer and a leveling layer. Usually, a black leveling layer and a black balance layer are laminated together as one layer for the base layer (sometimes, factory produces just one thicker layer). The leveling layer of the base layer would be the bottommost layer of the layer 101*c* of the piece 100.

The base layer, following cutting away portions of the piece 100 to form the plank 100*a* (wherein the base layer may be most of layer 102*c* and most of portion 103 in FIG. 3) may be comprised of one or more of the following materials polyvinyl chloride (PVC), calcium carbonate(filler), DOP or DINP, (DOP (Dioctyl Phthalate) is a combustible non-toxic colorless oily liquid with slight odor. Diisononyl phthalate (DINP) has similar functions and properties as DOP but environmental-friendly, a lubricant, a plasticizer, and/or various additives. The wear layer, such as on surface 102*a* in FIG. 3, the pattern film (thin layer underneath surface 102*a*), and the base layer (most of layer 102*c* and portion 3) may be laminated to each other through heat. The piece 100 of FIG. 2, may be initially formed by being die cut. However, in accordance with an embodiment of the present invention the piece 100 is not die cut in order to modify the piece 100 and to form plank 100*a*. The slots or channels 104, 106, 108, and 110 shown in FIG. 3, slots or channels 112, 116, 120, and 124 shown in FIG. 4, rails or protrusions 105, 107, 109, 113, and 115 shown in FIG. 3, and rails or protrusions 118 and 122 shown in FIG. 4 are typically not formed by being die cut.

Instead of die cutting to initially form the piece 100, another method such as waterjet, and CNC, Computer numerical control, which utilizes the commands of numerical control program(compiled by computer) to drive a motor of machine can be used.

After die cutting or some other method is used to initially form the piece 100, the piece 100 is modified into plank 100*a*. A bevel machine can be used which has a simple operation system to modify the piece 100 into the plank 100*a* and to thereby form the slots or channels 104, 106, 108, and 110 shown in FIG. 3, slots or channels 112, 116, 120, and 124 shown in FIG. 4, rails or protrusions 105, 107, 109, 113, and 115 shown in FIG. 3, and rails or protrusions 118 and 122 shown in FIG. 4. A CNC program can also be installed to be used with the bevel machine to modify the piece 100 into the plank 100*a* to be more computerized and automatic.

In order to produce the floor plank 100*a* from the piece 100, at least a lengthwise portion along length L1 of piece 100 and at least a width wise portion along width W1 of piece 100 are removed, typically to form an L-shaped portion, by cutting, beveling, etching, sculpting, carving, or chiseling out or otherwise removing various portions of the piece 100 of FIG. 2 to form the floor plank 100*a* of FIG. 3. The piece 100 may be cut or sculpted so that there are sides 102*e* and 102*g* formed, each of which is at a ninety degree angle with respect to the surface 102*a* as s shown in FIG. 3. The piece 100 may also be cut, beveled, etched, sculpted, carved, or chiseled out or otherwise have portions removed so that there are sides 103*d* and 103*e* formed, each of which is at a ninety degree angle with respect to the surface 103*a* or back of the plank 100*a* as shown in FIG. 4. Alternatively, sides 102*e* and 102*g*, and sides 103*d* and 103*e* may be beveled to be at an inclined or sloped so that sides 102*e* and 102*g* are not at a ninety degree angle with respect to surface 102*a*.

After the piece 100 of FIG. 2 is altered to the plank of 100*a* by cutting, beveling, etching, sculpting, carving, or chiseling out or otherwise removing various portions of the piece 100 of FIG. 2 to form the floor plank 100*a* of FIG. 3, glue is spread on or in slots or channels 104, 106, 108, and 110 shown in FIG. 3, slots or channels 112, 116, 120, and 124 shown in FIG. 4, rails or protrusions 105, 107, 109, 113, and 115 shown in FIG. 3, and rails or protrusions 118 and 122 shown in FIG. 4. In at least one embodiment of the present invention, glue is placed on or in all surfaces of the plank 100*a* which were formed by the step of cutting, beveling, etching, sculpting, carving, or chiseling out or otherwise removing various portions of the piece 100 of FIG. 2 to form the floor plank 100*a*. In at least one embodiment of the present invention, only the top surface 102*a* and the bottom surface 103*a* of the floor plank 100*a* will not have adhesive on them. Typically, all surfaces of the plank 100*a* which will come in contact with surfaces of another identical plank 100*a*, when the planks 100*a* are laid out in a floor pattern (i.e. not including the top surface 102*a* in FIG. 3 and the bottom surface 103*a* in FIG. 4) will have adhesive placed on them.

The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 are used for convenient position for better installation performance but are not required. If one or more slots 104, 106, 108, 110, 112, 116, 120, and 124 and rails 105, 107, 109, 113, and 115 are provided, they may be formed from the piece 100, by cutting the piece 100 of FIG. 2 by blade or alternative utility tools to form the plank 100*a*.

Adhesive may be spread out onto or in at least one of slot 104 in FIG. 3 and slot 116 in FIG. 4 and at least one of rail 103 in FIG. 3 or rail 118 in FIG. 4. Adhesive may also be spread out onto at least one of slot 106 in FIG. 3 or slot 112 in FIG. 4 and at least one of rail 107 in FIG. 3 and rail 113 in FIG. 4. In at least one embodiment a non-dry adhesive may be used for the adhesive. After forming plank 100*a* from piece 100 adhesive is spread at the factory on or in the appropriate slots or rails (such as one or more of slots 104, 116, 106, and 112 and one or more of rails 103, 118, 107, and 113), and then a piece of double sided coated paper is laid between two adjacent tiles/planks, each identical to floor plank 100*a*, to prevent contact between the two floor planks 100*a* and their adhesives before installation on a surface of a floor.

The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 can be various length or widths. The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 are used to align floor planks, such as floor planks 200 and 300 (each identical to 100*a*) as shown in FIGS. 5 and 6. The slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 are optional and can be eliminated in one or more embodiments.

In accordance with an embodiment of the present invention end-users don't have to spread any adhesive on tile/plank 100*a* or on the subfloor/underlayment. Also excessive adhesive will flow to a slot or channel instead of going up to the surface of a floor plank 100*a* or floor planks when they are abutted against one another. For example, excessive adhesive from rail 105 will flow into slot 104 in FIG. 3 and excessive adhesive from side rail 118 will flow into channel 116 shown in FIG. 4. The sides or vertical edges 102*d*, 102*e*, 102*f*, 102*g* shown in FIG. 3, and the side or vertical edges 103*c*, 103*d*, 103*e*, and 103*f* typically do not have adhesive initially applied to them, but rather adhesive may migrate to these sides or vertical edges from slots or rails when, for example, two identical planks 100*a* are connected together.

Non-dry adhesive will flow due to pressure or heat (or migration, which is kind of interaction between adhesive and DOP/DINP). Migration, to some customers which means excessive adhesive; but to those skilled in the art, it may also means that adhesive became watery, kind of deteriorated.

The piece 100 may have a length L1, which may for example be thirty-six or forty-eight inches or any other length, and a width W1, which may be three, four, six, eight, nine, or twelve inches or any other width. The piece 100 may be replaced by or may be a tile, such as a floor tile which may be twelve inches by twelve, sixteen by sixteen, eighteen by eighteen, twelve by twenty-four, twelve by eighteen inches or any other size. The length L2 of the portion 102 of the plank 100*a*, shown in FIG. 3 (wherein the portion 102 has a layer 102*b* which includes a wear layer and a pattern layer) may be ⅜ of an inch less than the length L1. The width W2 of the portion 102 of the plank 100*a*, shown in FIG. 3 may be ⅜ of an inch less than the width W1 (shown in FIG. 2). Similarly the length L2 and the width W2 of the portion 103 shown in FIG. 4 may be each be ⅜ of an inch less than the length L1 and the width W1, respectively of the piece 100 shown in FIG. 2. Each of the slots or channels 104, 106, 108, and 110 shown in FIG. 3, the slots or channels 112, 116, 120, and 124 shown in FIG. 4, the rails or protrusions 105, 107, 109, 113, and 115 shown in FIG. 3, and the rails or protrusions 118 and 122 shown in FIG. 4 may have a width (typically shorter dimension) of 3/16 inches. Alternatively, the width of each slot (wherein the width of each slot is much smaller than the length of the respective slot), such as slot 104, may be 0.9 millimeters and the width of each rail (wherein the width of each rail is much smaller than the length of the respective rail), such as rail 105, may be 1.8 millimeters.

In at least one embodiment, the plank 100*a* has the same overall length L1 as the piece 100, however, the layer 102*b* (including a pattern layer or design layer) has a shorter length L2, due to the fact that some of the layer 101*b* of the piece 100 is removed in the process of forming the layer 102*b* and the plank 100*a* from the piece 100.

For forming the sides by altering the piece 100, such as sides 102*d-g* and 103*c-e* shown in FIGS. 3 and 4, respectively, a machine may be used which uses a blade which may in some embodiments be the most economical way to form the sides, such as sides 102*d-e* and 103*c-d*. The sides, such as sides 102*d-g*, and 103*c-f* may be formed from the piece 100 with various different angles to make a plurality of planks, such as a plurality of identical planks 100*a*, look like real hardwood, or make tiles looks like they have grouts. In one embodiment a deep and vertical cut can be made, so that the surface of one or more of sides 102*d-g* and 103*c-f* are at a ninety degree angle with respect to surface 102*a* and the surfaces 102*d-g* and 103*c-f* are even or flat. Creating a ninety degree angle between surface 102*a* and one or more of surfaces 102*d-g* and surfaces 103*c-f* is easier to control and operate.

Other ways can be used to create the sides of 102*d-g* and 103*c-f* (such as laser, waterjet, CNC, and sandy wheel.

The floor plank 100*a* may have different patterns on the surface 102*a* of the portion 102, such as wood, stone, carpet, etc, different colors such as white, green, red, multiple colors, etc., different finishes, such as different coatings and different surface textures, such as with embossing.

The thickness of wear layer, such as on surface 102*a* in FIG. 3, and the overall floor plank 100*a* thickness T1, shown in FIG. 3 may vary. In at least one embodiment, the thickness T1 of the overall plank 100*a* (which is typically the same as the thickness of the piece 100 of FIG. 2) may be much less than the overall length L1 and the width W1 of the floor plank 100*a* and of the piece 100. The base layer, such as most of body portion 102*c* and portion 103 may be a rigid backing or a foam backing. The backing or base layer (most of body portion 102*c* and portion 103 may have an anti-skid bottom texture on the surface 103*a* shown in FIG. 4.

FIGS. 7-10 show left side, right side, top, and bottom views of a floor plank 400 in accordance with another embodiment of the present invention. The floor plank 400 may be identical to or substantially the same as the floor plank 100*a* of FIG. 3, with some optional additions or modifications as will be described. The floor plank 400 may include a top portion 402 and a bottom portion 403 as shown by FIGS. 7-10. The floor plank 400 may include slots or channels 404, 406, 408, 410, and 412 which may be similar to or identical to slots or channels 104, 106, 108, 110, and 112 shown in FIG. 3 for floor plank 100*a*. The floor plank 400 may include rails 405, 407, 409, and 413 which may be similar to or identical to rails 105, 107, 109, and 113 shown in FIG. 3 for floor plank 100*a*. The floor plank 400 may also include grooves or further channels 406*a-b* and 404*a-b* shown in FIG. 9 and grooves or further channels 412*a-b*, and 416*a-b* shown in FIG. 10. The further grooves or channels 404*a-b*, 406*a-b*, 412*a-b*, and 416*a-b* may be added to the plank 100*a* to form a modified version of plank 100*a*. The further grooves or channels 404*a-b*, 406*a-b*, 412*a-b*, and 416*a-b* are used to allow excessive adhesive to flow into the further grooves or channels 404*a-b*, 406*a-b*, 412*a-b*, and 416*a-b*. The further grooves or channels 404*a-b*, 406*a-b*, 412*a-b*, and 416*a-b* are optional and depending on what kind of adhesive or cement is used, may or may not be useful or needed.

In accordance with a method and/or apparatus of an embodiment of the present invention a piece, such as piece 100 in FIG. 2, is produced and shaped through die cut and then sent to a machine to form the plank 100*a* of FIG. 3, such as to a bevel machine. In accordance with at least one embodiment of the present invention, the machine, such as a bevel machine, forms at least two sides of the top portion 102 shown in FIG. 3: one of the sides is a side running the length L2 of the plank 100*a*, such as side 102*d* or side 102*e*, and one of the sides is a side running the width W2 of the plank 100*a*, such as side 102*f* or 102*g*.

The process for producing the piece 100 of FIG. 2, prior to the forming, sculpting, cutting or beveling step may be a process which is known, such as, mass production thru die-cut or saw, or waterjet, which is typically used for special custom size or shape, for producing known vinyl tile/plank products. The piece 100 of FIG. 2 may have been shaped through a die-cut process.

In addition to forming at least two sides to form the top portion 102 in forming the plank 100*a*, at least one embodiment of the present invention includes forming at least two sides of the bottom portion 103, including at least one length wise, L2 side, such as either of sides 103*c* and 103*d*, and at least one widthwise side such as either of sides 103*e* and 103*f* shown in FIG. 4.

The step of cutting, beveling, etching, sculpting, carving, or chiseling out or otherwise removing various portions of the piece 100 of FIG. 2 to form the floor plank 100*a* of FIG. 3 may change the angle of a side, with respect to a neighboring top surface, such as the angle of side 2*d* with respect to top surface 2*a* from ninety degrees to another angle.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprising the steps of :

putting together a first piece, wherein the first piece is comprised of a wear layer, a pattern layer, and a base layer, with the wear layer, the pattern layer, and the base layer arranged in a sandwich manner, such that the wear layer is on top of the pattern layer, the pattern layer is on top of the base layer, and the pattern layer is in between the wear layer and the base layer; and removing portions of the first piece to form a first floor plank, such that the first floor plank includes a part of the wear layer of the first piece but not all of the wear layer of the first piece;

wherein the first floor plank has a length, a width, and a thickness, such that the length is substantially greater than the width and the thickness;

wherein the step of removing portions of the first piece to form a first floor plank forms a first vertical channel;

wherein the first vertical channel has a left side wall, a right side wall, and a bottom, which together form a first U-shape, such that each of the left side wall and the right side wall of the first vertical channel is substantially perpendicular to the length of the first floor plank, and the bottom of the first vertical channel is substantially parallel to the length of the first floor plank; and wherein each of the left side wall and the right side wall extends from the bottom of the first vertical channel towards the part of the wear layer of the first piece, which is included in the first floor plank;

wherein the step of removing portions of the first piece to form a first floor plank forms a second vertical channel;

wherein the second vertical channel has a left side wall, a right side wall, and a bottom, which together form a second U-shape, such that each of the left side wall and the right side wall of the second vertical channel is substantially perpendicular to the length of the first floor plank, and the bottom of the second vertical channel is substantially parallel to the length of the first floor plank; and wherein each of the left side wall and the right side wall of the second vertical channel extends from the bottom of the second vertical channel toward the part of the wear layer of the first piece, which is included in the first floor plank; and wherein each of the left side wall and the right side wall of the second vertical channel extends from the bottom of the second vertical channel to the bottom of the first vertical channel.

2. The method of claim 1 wherein the step of removing portions of the first piece to form a first floor plank includes removing a first substantially L-shaped portion of the wear layer;

removing a second substantially L-shaped portion of the pattern layer; and removing a third substantially L-shaped portion of the base layer;

wherein the first substantially L-shaped portion of the wear layer and the second substantially L-shaped portion of the pattern layer are substantially the same size and shape, and are substantially aligned with one another prior to being removed from the first piece; and wherein the third substantially L-shaped portion of the base layer is not aligned with the second substantially L-shaped portion of the pattern layer or the first substantially L-shaped portion of the wear layer prior to being removed from the first piece.

3. The method of claim 1 wherein the step of removing portions of the first piece to form a first floor plank is performed by a machine.

4. The method of claim 1 wherein the step of removing portions of the first piece to form a first floor plank is performed by a bevel machine.

5. The method of claim 1 further comprising applying adhesive to locations on the first floor plank corresponding to where portions of the first piece have been removed.

6. The method of claim 5 further comprising applying a removable covering to the adhesive so that the first floor plank can be stored for later installation as part of a floor covering.

7. The method of claim 2 wherein the step of removing the first substantially L-shaped portion of the wear layer and the second substantially L-shaped portion of the pattern layer includes forming a first substantially L-shaped slot and a first substantially L-shaped rail; and the step of removing the third substantially L-shaped portion of the base layer includes forming a second substantially L-shaped slot and a second substantially L-shaped rail.

8. The method of claim 7 further comprising applying adhesive to at least one of the first and the second substantially L-shaped slots.

9. The method of claim 8 further comprising applying adhesive to at least one of the first and second substantially L-shaped rails.

10. The method of claim 9 further comprising applying a removable covering to the adhesive of the at least one of the first and the second substantially L-shaped slots or of the at least one of the first and second substantially L-shaped rails so that the first floor plank can be stored for later installation as part of a floor covering.

11. The method of claim 6 further comprising removing the removable covering from the first floor plank, and adhering the first floor plank to a second floor plank, which is substantially identical to the first floor plank, by adhering locations on the first floor plank corresponding to where portions of the first piece have been removed to locations on the second floor plank corresponding to where portions of a second piece have been removed, wherein the second piece is substantially identical to the first piece.

12. The method of claim 1 further comprising adhering the first floor plank to a second floor plank which is substantially identical to the first floor plank, by adhering locations on the first floor plank corresponding to where portions of the first piece have been removed to locations on the second floor plank corresponding to where portions of a second piece have been removed, wherein the second piece is substantially identical to the first piece.

13. The method of claim 1 further comprising wherein the step of removing portions of the first piece to form a first floor plank forms a third vertical channel;

wherein the third vertical channel has a left side wall, a right side wall, and a bottom, which together form a third U-shape, such that each of the left side wall and the right side wall of the third vertical channel is substantially perpendicular to the length of the first floor plank, and the bottom of the third vertical channel is substantially parallel to the length of the first floor plank; and wherein each of the left side wall and the right side wall of the third vertical channel extends from the bottom of the third vertical channel away from the part of the wear layer of the first piece, which is included in the first floor plank.

14. The method of claim 1 further comprising wherein the step of removing portions of the first piece to form a first floor plank forms a third vertical channel;

wherein the third vertical channel has a left side wall, a right side wall, and a bottom, which together form a third U-shape, such that each of the left side wall and the right side wall of the third vertical channel is substantially perpendicular to the length of the first floor plank, and the bottom of the third vertical channel is substantially parallel to the width of the first floor plank; and wherein each of the left side wall and the right side wall of the third vertical channel extends from the bottom of the third vertical channel towards the part of the wear layer of the first piece, which is included in the first floor plank;

and wherein the first vertical channel is substantially perpendicular to the third vertical channel.

15. The method of claim 14 further comprising wherein the step of removing portions of the first piece to form a first floor plank forms a fourth vertical channel;

wherein the fourth vertical channel has a left side wall, a right side wall, and a bottom, which together form a fourth U-shape, such that each of the left side wall and the right side wall of the fourth vertical channel is substantially perpendicular to the length of the first floor plank, and the bottom of the fourth vertical channel is substantially parallel to the length of the first floor plank; and wherein each of the left side wall and the right side wall of the fourth vertical channel extends from the bottom of the fourth vertical channel away from the part of the wear layer of the first piece, which is included in the first floor plank;

and wherein the fourth vertical channel is substantially parallel to the first vertical channel.

16. The method of claim 15 further comprising wherein the step of removing portions of the first piece to form a first floor plank forms a fifth vertical channel;

wherein the fifth vertical channel has a left side wall, a right side wall, and a bottom, which together form a fifth U-shape, such that each of the left side wall and the right side wall of the fifth vertical channel is substantially perpendicular to the length of the first floor plank, and the bottom of the fifth vertical channel is substantially parallel to the width of the first floor plank; and wherein each of the left side wall and the right side wall of the fifth vertical channel extends from the bottom of the fifth vertical channel away from the part of the wear layer of the first piece, which is included in the first floor plank;

and wherein the fifth vertical channel is substantially parallel to the third vertical channel.

17. A method comprising the steps of:

putting together a first piece, wherein the first piece is comprised of a wear layer, a pattern layer, and a base layer, with the wear layer, the pattern layer, and the base layer arranged in a sandwich manner, such that the wear layer is on top of the pattern layer, the pattern layer is on top of the base layer, and the pattern layer is in between the wear layer and the base layer; and removing portions of the first piece to form a first floor plank, such that the first floor plank includes a part of the wear layer of the first piece but not all of the wear layer of the first piece;

wherein the first floor plank has a length, a width, and a thickness, such that the length is substantially greater than the width and the thickness;

wherein the step of removing portions of the first piece to form a first floor plank forms a first vertical channel;

wherein the first vertical channel has a left side wall, a right side wall, and a bottom, which together form a first U-shape, such that each of the left side wall and the right side wall of the first vertical channel is substantially perpendicular to the length of the first floor plank, and the bottom of the first vertical channel is substantially parallel to the length of the first floor plank; and wherein each of the left side wall and the right side wall extends from the bottom of the first vertical channel towards the part of the wear layer of the first piece, which is included in the first floor plank;

wherein the step of removing portions of the first piece to form a first floor plank forms a second vertical channel;

wherein the second vertical channel has a left side wall, a right side wall, and a bottom, which together form a second U-shape, such that each of the left side wall and the right side wall of the second vertical channel is substantially perpendicular to the length of the first floor plank, and the bottom of the second vertical channel is substantially parallel to the length of the first floor plank;

wherein each of the left side wall and the right side wall of the second vertical channel extends from the bottom of the second vertical channel away from the part of the wear layer of the first piece, which is included in the first floor plank;

wherein the step of removing portions of the first piece to form a first floor plank forms a third vertical channel;

wherein the third vertical channel has a left side wall, a right side wall, and a bottom, which together form a third U-shape, such that each of the left side wall and the right side wall of the third vertical channel is substantially perpendicular to the length of the first floor plank, and the bottom of the third vertical channel is substantially parallel to the length of the first floor plank;

wherein each of the left side wall and the right side wall of the third vertical channel extends from the bottom of the third vertical channel to the bottom of the first vertical channel;

wherein the step of removing portions of the first piece to form a first floor plank forms a fourth vertical channel;

wherein the fourth vertical channel has a left side wall, a right side wall, and a bottom, which together form a fourth U-shape, such that each of the left side wall and the right side wall of the fourth vertical channel is substantially perpendicular to the length of the first floor plank, and the bottom of the fourth vertical channel is substantially parallel to the width of the first floor plank; and wherein each of the left side wall and the right side wall of the fourth vertical channel extends from the bottom of the fourth vertical channel to the bottom of the second vertical channel.

18. A method comprising the steps of :

putting together a first piece, wherein the first piece is comprised of a wear layer, a pattern layer, and a base layer, with the wear layer, the pattern layer, and the base layer arranged in a sandwich manner, such that the wear layer is on top of the pattern layer, the pattern layer is on top of the base layer, and the pattern layer is in between the wear layer and the base layer; and removing portions of the first piece to form a first floor plank, such that the first floor plank includes a part of the wear layer of the first piece but not all of the wear layer of the first piece;

wherein the first floor plank has a length, a width, and a thickness, such that the length is substantially greater than the width and the thickness;

wherein the step of removing portions of the first piece to form a first floor plank forms a first vertical channel;

wherein the first vertical channel has a left side wall, a right side wall, and a bottom, which together form a first U-shape, such that each of the left side wall and the right side wall of the first vertical channel is substantially perpendicular to the length of the first floor plank, and the bottom of the first vertical channel is substantially parallel to the length of the first floor plank; and wherein each of the left side wall and the right side wall extends from the bottom of the first vertical channel towards the part of the wear layer of the first piece, which is included in the first floor plank;

wherein the step of removing portions of the first piece to form a first floor plank forms a second vertical channel;

wherein the second vertical channel has a left side wall, a right side wall, and a bottom, which together form a second U-shape, such that each of the left side wall and the right side wall of the second vertical channel is substantially perpendicular to the length of the first floor plank, and the bottom of the second vertical channel is substantially parallel to the width of the first floor plank;

wherein each of the left side wall and the right side wall of the second vertical channel extends from the bottom of the second vertical channel towards the part of the wear layer of the first piece, which is included in the first floor plank;

wherein the first vertical channel is substantially perpendicular to the second vertical channel;

wherein the step of removing portions of the first piece to form a first floor plank forms a third vertical channel;

wherein the third vertical channel has a left side wall, a right side wall, and a bottom, which together form a third U-shape, such that each of the left side wall and the right side wall of the third vertical channel is substantially perpendicular to the length of the first floor plank, and the bottom of the third vertical channel is substantially parallel to the length of the first floor plank;

wherein each of the left side wall and the right side wall of the third vertical channel extends from the bottom of the third vertical channel to the bottom of the first vertical channel;

wherein the step of removing portions of the first piece to form a first floor plank forms a fourth vertical channel;

wherein the fourth vertical channel has a left side wall, a right side wall, and a bottom, which together form a fourth U-shape, such that each of the left side wall and the right side wall of the fourth vertical channel is substantially perpendicular to the length of the first floor plank, and the bottom of the fourth vertical channel is substantially parallel to the width of the first floor plank; and wherein each of the left side wall and the right side wall of the fourth vertical channel extends from the bottom of the fourth vertical channel to the bottom of the second vertical channel.

* * * * *